US011643917B2

(12) United States Patent
Newport et al.

(10) Patent No.: US 11,643,917 B2
(45) **Date of Patent: *May 9, 2023**

(54) VARIABLE WIDTH SAND BRIDGE INDUCER

(71) Applicant: Halliburton Energy Services, Inc., Houston, TX (US)

(72) Inventors: Casey Laine Newport, Houston, TX (US); Robert Charles Delong, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/751,164

(22) Filed: May 23, 2022

(65) Prior Publication Data

US 2022/0282608 A1 Sep. 8, 2022

Related U.S. Application Data

(63) Continuation of application No. 16/928,187, filed on Jul. 14, 2020, now Pat. No. 11,365,619.

(51) Int. Cl.
*E21B 43/38* (2006.01)
*E21B 34/08* (2006.01)
*E21B 43/12* (2006.01)

(52) U.S. Cl.
CPC ..... *E21B 43/38* (2013.01); *E21B 34/08* (2013.01); *E21B 43/128* (2013.01)

(58) Field of Classification Search
CPC ..... E21B 43/025; E21B 43/04; E21B 43/045; E21B 43/38; E21B 43/128
See application file for complete search history.

(56) References Cited

U.S. PATENT DOCUMENTS 1,354,027 A * 9/1920 Crowell ..... E21B 43/121 251/339
5,379,835 A * 1/1995 Streich ..... E21B 33/14 166/327

(Continued)

FOREIGN PATENT DOCUMENTS

EP 2655789 B1 9/2019
WO 2022015290 A1 1/2022

OTHER PUBLICATIONS

Foreign Communication from Related Application—International Search Report and Written Opinion of the International Searching Authority, International Application No. PCT/US2020/041935, dated Apr. 2, 2021, 7 pages.

*Primary Examiner* — David Carroll
(74) *Attorney, Agent, or Firm* — Conley Rose, P.C.; Rodney B. Carroll

(57) ABSTRACT

A downhole tool for preventing pump blockage includes an outer conduit defining an outer flow path, an inner conduit located within the outer conduit defining an inner flow path and a space between the inner conduit and the outer conduit. The inner conduit includes one or more angled passageways to allow one-way debris flow. A pressure regulated valve is coupled to the upper end of the outer conduit and configured to open to expand an adjustable width angled passageway defined by the pressure regulated valve. An upper end of the inner conduit is configured to allow fluid bypass of the angled passageways of the inner conduit when the angled passageways are blocked with debris.

20 Claims, 3 Drawing Sheets

(56) References Cited

U.S. PATENT DOCUMENTS

| | | | | |
|---|---|---|---|---|
| 8,863,849 | B2 | 10/2014 | Patel | |
| 10,082,014 | B2 | 9/2018 | Fielder, III et al. | |
| 11,365,619 | B2 | 6/2022 | Newport et al. | |
| 2012/0132414 | A1* | 5/2012 | Lawson | E21B 43/128 166/105 |
| 2017/0328190 | A1* | 11/2017 | Fielder, III | E21B 34/08 |
| 2019/0029687 | A1* | 1/2019 | Leitch | E21B 43/08 |
| 2019/0203565 | A1 | 7/2019 | Reed et al. | |
| 2019/0271210 | A1* | 9/2019 | Reed | E21B 21/103 |
| 2020/0291744 | A1* | 9/2020 | Reed | E21B 34/066 |

* cited by examiner

VARIABLE WIDTH SAND BRIDGE INDUCER

CROSS REFERENCE TO RELATED APPLICATIONS

This application is a continuation of and claims priority to U.S. patent application Ser. No. 16/928,187, filed on Jul. 14, 2020 and published as U.S. Patent Application Publication No. 2022/0018236 A1, and entitled "Variable Width Sand Bridge Inducer," which is incorporated by reference herein in its entirety.

TECHNICAL FIELD

The present disclosure relates to downhole tools, and more particularly to tools for reduction of inoperability and/or damage of electrical submersible pumps during restarts due to solid particle (e.g., formation sand, proppant, and the like) fall back such as used in oil and gas wells.

BACKGROUND

Natural formation sands, hydraulic fracturing proppant (referred to herein as sand) in subterranean oil and gas wells, and solid particles entrained within the produced fluid could also be from scale and/or rust from corroded production tubing, and salts that precipitate in the fluid stream during temperature and pressure changes while traveling to the surface can cause significant problems for electrical submersible pumps (ESPs). Once this debris is produced it must pass through the tubing string prior to reaching the surface. These debris particles often hover or resist further downstream movement in the fluid stream above the ESP or move at a much slower velocity than the well fluid due to physical and hydrodynamic effects. When the ESP is unpowered, fluid with entrained solid particles in the tubing string above the pump begins to flow back through the pump. Check valves are often used to prevent flow back while also maintaining a static fluid column in the production tubing.

Such conventional methods and systems have generally been considered satisfactory for their intended purpose, as these tubes tend to become blocked and clogged resulting in difficulties restarting the ESP. However, there is still a need in the art for improved debris fallback prevention/mitigation tools that protect the operability and reliability of ESPs. The present disclosure provides a solution for this need.

BRIEF SUMMARY OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION

Figure 1A:
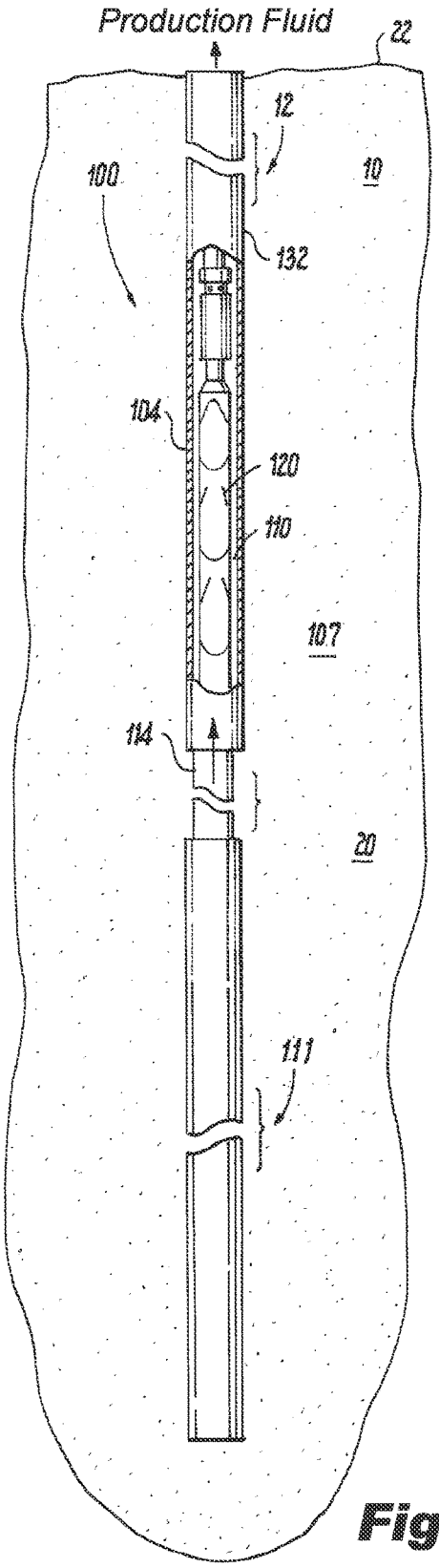
FIG. 1A is a schematic side elevation view of an exemplary embodiment of a downhole tool constructed in accordance with the present disclosure, showing the downhole tool in a string that includes a motor and electrical submersible pump (ESP), wherein the string is in a formation for production of well fluids that may contain any combination of water, hydrocarbons, and minerals that naturally occur in oil and gas producing wells.

Reference will now be made to the drawings wherein like reference numerals identify similar structural features or aspects of the subject disclosure. For purposes of explanation and illustration, and not limitation, a partial view of an exemplary embodiment of a downhole tool 100 in accordance with the disclosure is shown in FIGS. 1A and 1*s* designated generally by reference character 100. Other embodiments of downhole tools in accordance with the disclosure, or aspects thereof, are provided in FIGS. 1B-3B, as will be described. The systems and methods described herein can be used to prevent the fall-back of sand and other solids from packing on top of the uppermost pump of an ESP string after a shutdown event. Solids packed on top of or inside a pump can lead to hard starting issues and failure of the shafts due to torsional overloading during attempted restarts. This design incorporates sand bridging slots with at least one having a variable width for passing large solids.

Figure 1B:
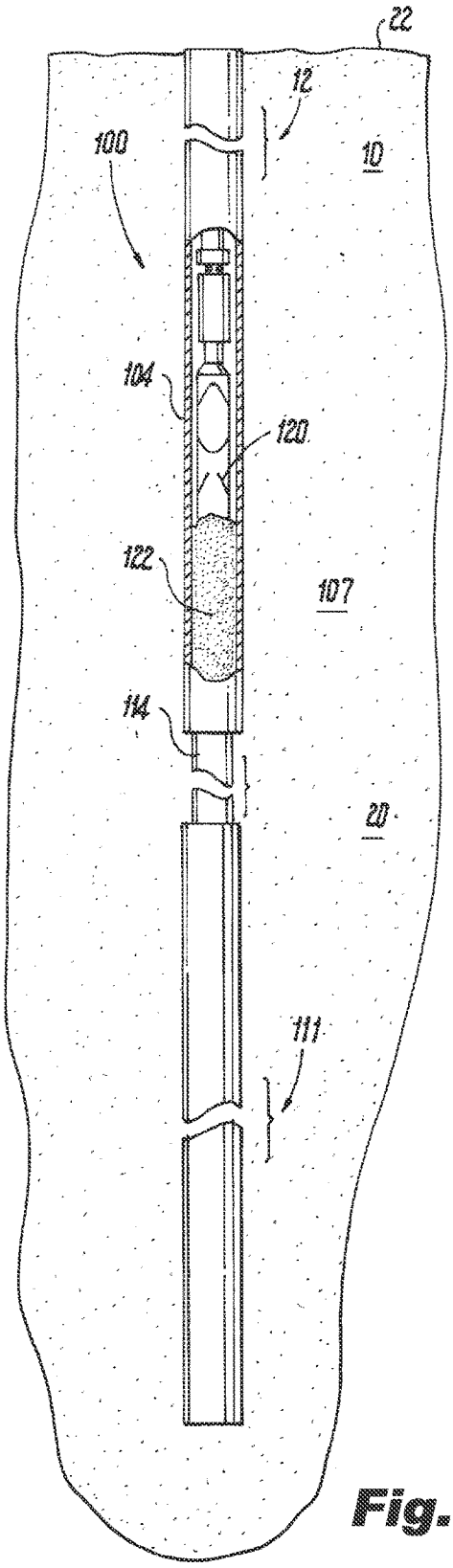
FIG. 1B is a schematic side elevation view of the downhole tool of FIG. 1A, showing the system blocked off with fall-back sand.

As seen in FIG. 1A, a production string 10 is shown that includes production tubing 12, downhole tool 100, and ESP 111. These components are strung together in a formation for production, e.g., of oil, gas and/or water, from within formation 20. In FIG. 1A, the flow arrows indicate operation of ESP 111 to receive fluids from formation 20 then drive the fluids through production tubing 12 and downhole tool 100 to the surface 22. As an ESP 111 operates it produces production fluid 114 having debris particles, such as sand, which is carried to the surface along with the production fluid 114. Further seen in FIG. 1A, the production fluid 114 along with the sand flows from a downhole reservoir through a lower section 106 to a second section 107 and on to an upper section 132. FIG. 1A shows normal operation with the production fluid 114 following a path through the inner conduit 102 through a plurality of angled passageways 120 and an adjustable angled passageway 121 located at the upper end of the inner conduit for passing large solids. As shown in FIG. 1B, when ESP 111 stops pumping or is powered down, for maintenance or other reasons, fall-back sand 122 in the production tubing 12 above downhole tool 100 recedes down towards the ESP 111, but is mitigated or prevented from reaching ESP 111 by a plurality of angled passageways 120. However, the sand and other debris particles become stacked and are retained within the space 110 between the outer conduit 104 and the plurality of angled passageways 120 of the inner conduit 102 forming a sand bridge 122. The sand bridge 122 prevents solids from clogging the top ESP pump diffuser and/or impeller and reduces hard starting issues and failures of the ESP pump shaft due to torsional overloading during attempted restarts. By using the downhole tool 100 described below while restarting the pump where a sand bridge 122 is in place allows the production fluid 114 to flow through the adjustable angled passage ways 121 fluidizing the sand bridge 122 for a required amount of time, until the sand bridge 122 has dispersed or at least partially cleared. The area of the adjustable angled passageways is enlarged as pressure from downhole fluids increases, forcing the pressure regulated valve in an upward direction.

Figure 2A:
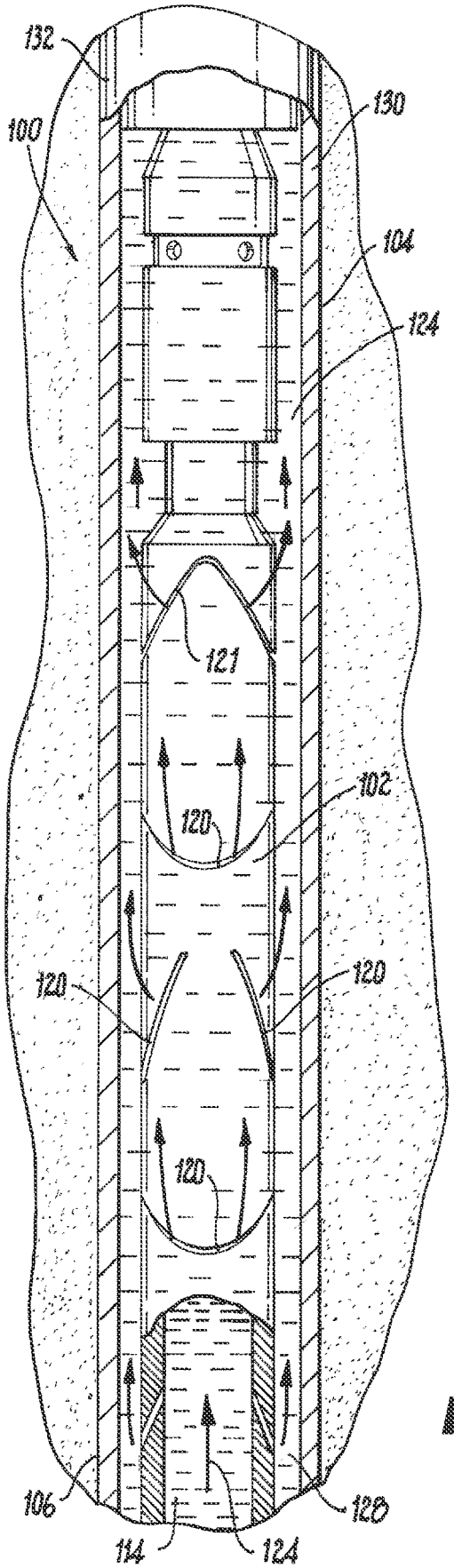
FIG. 2A is a schematic cross-sectional elevation view of the downhole tool of FIGS. 1A and 1B, showing the pressure regulated valve stationary in the closed position with flow arrows indicating the flow during normal operation.

FIG. 2A shows a close-up view of the downhole tool 100 for preventing pump blockage. The downhole tool 100 includes an outer conduit 104 which defines a vertical flow path. The outer conduit 104 has a lower end 128 and an upper end 130. The outer conduit 104 attaches to a lower section 106 at the lower end 128 and to an upper section 132 of the production tubing 12 at the upper end 130. An inner conduit 102 is located within the outer conduit 104 and defines an inner flow path 124 for the production fluid 114. The inner conduit 102 and the outer conduit 104 define a space 110 between the two conduits. The inner conduit 102 includes one or more angled passageways 120 configured to allow one-way debris flow. During normal operation, the flow passes through the inner conduit 102, through the angled passageways 120 into the space 110, and through the outer conduit 104 into the upper section 132.

At least one of the one or more angled passageways 120 can be sized to promote a sand bridging effect therein without allowing sand to travel across it, or to travel only in one direction. The one or more angled passageways 120 can include at least two passageways of different flow area. The design utilizes variable EDM (electrical discharge machining) to cut slot widths to realize a robust and easily manufactured apparatus. Variable slot widths provide a mechanism to handle multiple sizes of sand particles without plugging and will allow for slug flow to pass through the downhole tool 100 without impeding production.

Figure 2B:
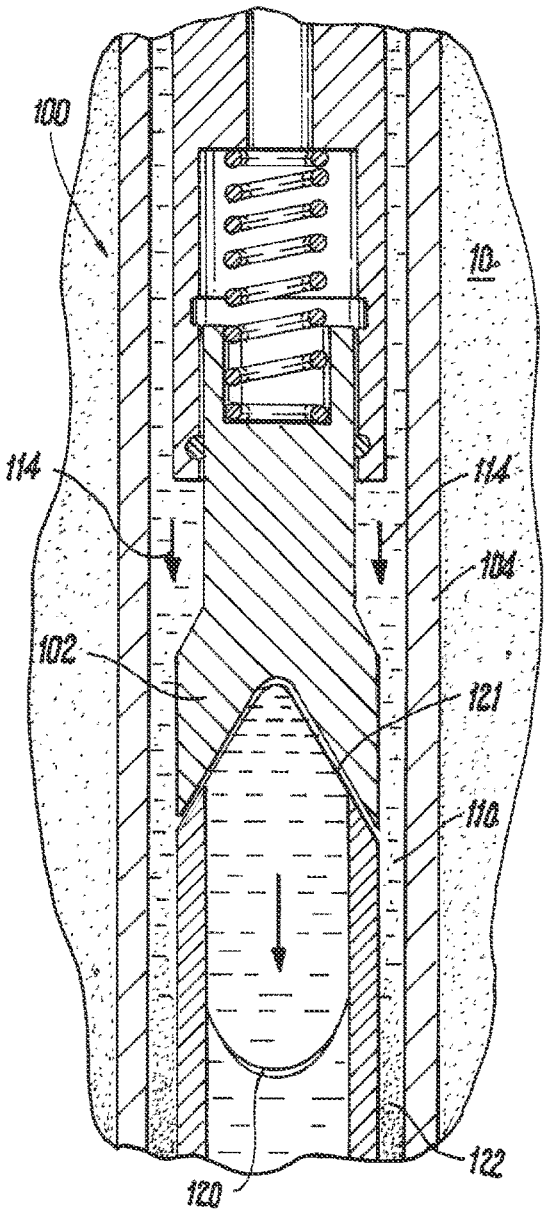
FIG. 2B is a schematic cross-sectional elevation view of the downhole tool of FIGS. 1A and 1B, showing the pressure regulated valve in the closed position showing sand blockage.

FIG. 2B shows the system 100 when the ESP 111 (shown in FIG. 1) has been shut down, or put on idle. As the production fluid 114 is pulled back down through the production string 10 by gravity, the sand particles that did pass through the angled passageways 120 are now collected as a sand bridge 122 in the space 110 between the inner conduit 102 and the outer conduit 104.

Figure 2C:
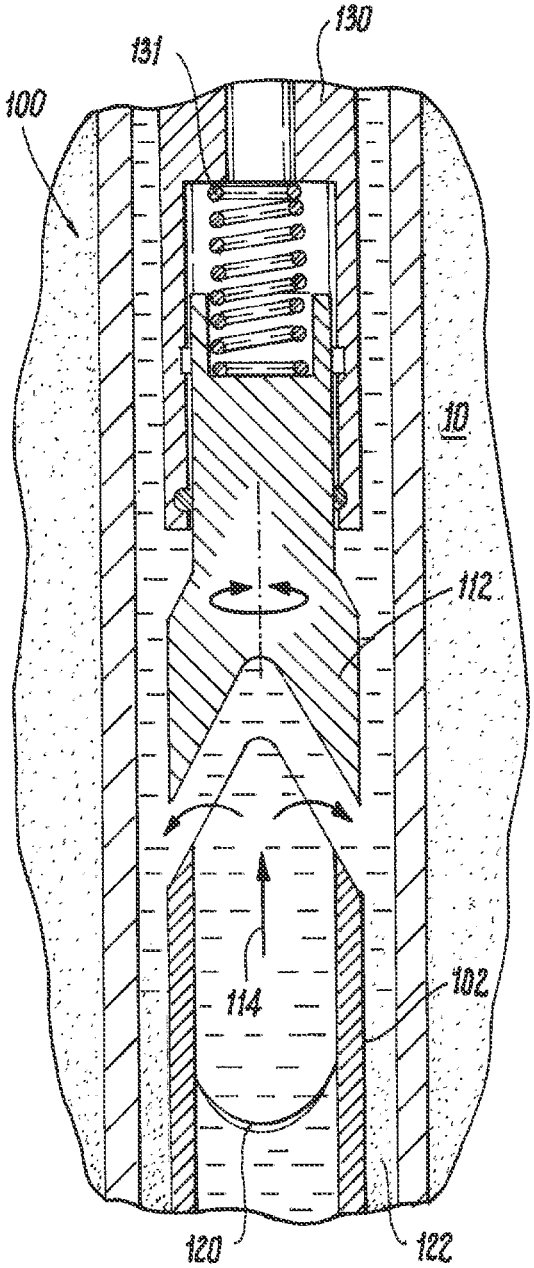
FIG. 2C is a schematic cross-sectional elevation view of the downhole tool of FIGS. 1A and 1B, showing the pressure regulated valve in an open position with flow arrows indicating the flow during a blocked re-start.

FIG. 2C shows the system which has been restarted or powered up after a shut down. The adjustable angled passageways are enlarged state for passing large solids or venting excess pressures as the pressure regulated valve has been pressed to open upwards. As the ESP 111 (FIG. 1) is powered back on, the production fluid 114 presses against a pressure regulated valve 112 which enlarges the adjustable angled passageway 121 between the upper end 130 of the inner conduit 102 and the pressure regulated valve 112. The pressure regulated valve 112 opens to allow large solids entrained within production fluid 114 or excessive fluid pressure to bypass the angled passageways 120 of the inner conduit 102 when the angled passageways 120 are blocked with debris 122. The pressure regulated valve 112 is opened by pressure from the downhole production fluid 114 as it moves through the inner conduit 102. The pressure regulated valve 112 can also be opened manually from an above ground control center (not shown). The pressure regulated valve 112 can be coupled to the upper end 130 with a spring 131 or other absorber or dampener in order to force it shut during normal operation and to ease it back into place after the pressure from the production fluid 114 subsides. As the fluid 114 travels through the opened pressure regulated valve 112 and enlarged adjustable width angled passageway 121, the inner conduit is cleared of large solids allowing the production fluid 114 to once again travel through the angled passageways 120. As the fluid 114 articulates the pressure regulated valve 112, the pressure of the fluid can turn and spin the pressure regulated valve 112. This function allows the pressure regulated valve 112 to pass large solids, or groups of large solids and handle a wide range of pressures without being damaged if experiencing asymmetric pressures and still be able to close after the pressure has subsided.

Figure 3A:
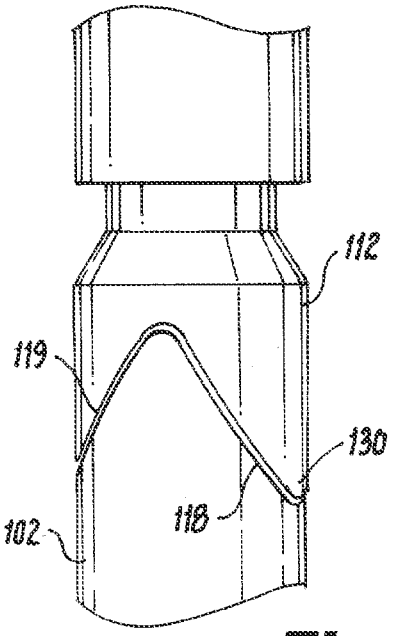
FIG. 3A is a schematic cross-sectional elevation view of the valve of the downhole tool of FIGS. 1A and 1B, showing the interface of the pressure regulated valve stationary with the inner tube in a closed position.
Figure 3B:
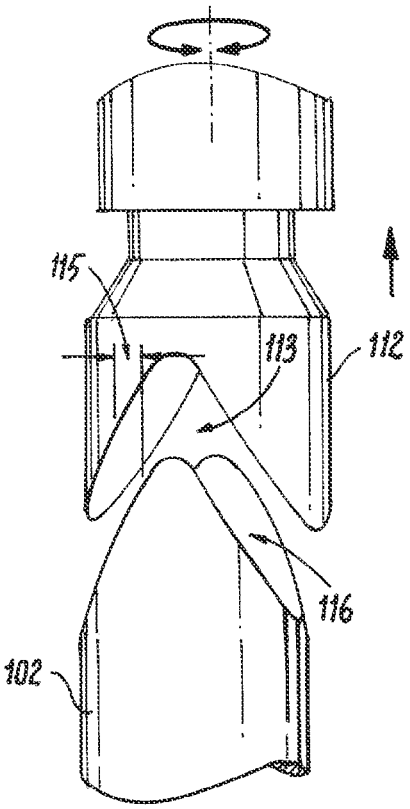
FIG. 3B is a side view of the pressure regulated valve of the downhole tool of FIGS. 1A and 1B, showing the interface of the pressure regulated valve and the inner conduit in an articulated and open position.

FIG. 3A shows the interface between the inner conduit 102 and the pressure regulated valve 112. The inner conduit 102 has an upper end 130 with a first angled face 118 and a second angled face 119. Each of the angled faces 118, 119 include a concave opening 116. The angled faces 118, 119 do not contact the pressure regulated valve when in the closed position and form the adjustable angled passageways 121 with the same size as the angled passageways. The concave openings 116 shown in FIG. 3B are smooth and rounded, however, other opening shapes can also be used, including ones having angles, and non-widening shapes, such as rectangular openings having right angles. FIG. 3B shows the adjustable width angled passageway 121 with the pressure regulated valve 112 in an articulated position. The interface of the pressure regulated valve 112 shown here is V-shaped and orients the angled faces 118, 119 of the inner conduit 102. The V-shape can use any suitable non-right angle. A benefit of the V-shaped interface 113 is that as the adjustable width angled passageway 121 opens, the size of the opening 115 between the inner conduit 102 and the pressure regulated valve 112 enlarges, allowing for a smoother opening and closing.

Thus, as described above, embodiments of the present disclosure may be implemented in a number of ways. In accordance with any of the foregoing embodiments, a downhole tool for preventing pump blockage includes an outer conduit defining an outer flow path therethrough in an axial direction having a lower end and an upper end, an inner conduit located within the outer conduit defining an inner flow path therethrough in the axial direction and an space between the inner conduit and the outer conduit, wherein the inner conduit includes one or more angled passageways configured to allow one-way debris flow, and a pressure regulated valve coupled to the upper end of the outer conduit configured to open to expand an adjustable width angled passageway defined by the pressure regulated valve and an upper end of the inner conduit configured to allow fluid bypass of the angled passageways of the inner conduit when the angled passageways are blocked with debris.

In accordance with any of the foregoing embodiments, the inner conduit can include an upper end having a first angled face and a second angled face, where each of the angled faces can include a concave opening.

In accordance with any of the foregoing embodiments, the pressure regulated valve can include an interface contacting the upper end of the inner conduit when the angled passageways of the inner conduit are open. The interface of the pressure regulated valve can be V-shaped and can be configured to orient with the angled faces of the inner conduit and form the adjustable width angled passageway.

In accordance with any of the foregoing embodiments, the pressure regulated valve can be rotatably coupled to the upper end of the outer conduit. The pressure regulated valve can be coupled to the upper end of the outer conduit by a spring. The pressure regulated valve can be retractably coupled to the upper end of the outer conduit.

In accordance with any of the foregoing embodiments, the bottom end of the outer conduit can be sealed to the inner conduit. The inner conduit can be configured to receive fluid from a lower section. The outer conduit can be configured to pass fluid to an upper section.

In accordance with any of the foregoing embodiments the one or more angled passageways include at least two passageways of different flow area from one another. The at least one of the one or more angled passageways can be sized to promote a sand bridging effect therein without allowing sand to travel into the inner conduit.

In accordance with any of the foregoing embodiments, the system can also include an electrical submersible pump operatively coupled to the inner conduit.

In accordance with any of the foregoing embodiments a method of passing downhole fluid through a wellbore includes pumping fluid having debris particles therein from a lower section to a second section; pumping the fluid through to an upper section from the second section following a first path, shutting off a pump and allowing fluid to flow in reverse through the second section, collecting debris particles in the second section, and restarting the pump allow fluid from the lower section to the upper section. The debris can be sand. A adjustable width angled passageway can articulate allowing fluid to bypass the collected debris particles.

The debris cab be bypassed by the fluid at an upper portion of the second section. The restart fluid can enlarge an area of the adjustable width angled passageway. The method can include closing a pressure regulated valve.

The methods and systems of the present disclosure, as described above and shown in the drawings, provide for reduction or prevention of fall-back sand reaching an ESP, and improving restarting abilities of the ESP with superior properties including accommodation for desirable back flow, extended useable life, and improved reliability relative to traditional systems and methods.

While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A downhole tool for preventing pump blockage comprising:

an outer conduit defining an outer flow path therethrough in an axial direction having a lower end and an upper end;

an inner conduit located within the outer conduit defining an inner flow path therethrough in the axial direction and a space between the inner conduit and the outer conduit, wherein the inner conduit includes one or more angled passageways configured to allow one-way debris flow, wherein at least one of the angled passageways is formed having a variable slot width across its length to permit passage of varying size particles without clogging, and wherein the inner conduit includes an upper end having a first angled face and a second angled face; and a pressure regulated valve coupled to the upper end of the outer conduit configured to open to expand an adjustable width angled passageway defined by the pressure regulated valve and an upper end of the inner conduit configured to allow fluid bypass of the angled passageways of the inner conduit when the angled passageways are blocked with debris.

2. The downhole tool of claim 1, wherein each of the angled faces include a concave opening.

3. The downhole tool of claim 1, wherein the pressure regulated valve includes an interface contacting the upper end of the inner conduit when the angled passageways of the inner conduit are open.

4. The downhole tool of claim 3, wherein the interface of the pressure regulated valve is V-shaped and is configured to orient with the angled faces of the inner conduit and form the adjustable width angled passageway.

5. The downhole tool of claim 4, wherein the pressure regulated valve is rotatably coupled to the upper end of the outer conduit, wherein the pressure regulated valve is coupled to the upper end of the outer conduit by a spring, or wherein the pressure regulated valve is retractably coupled to the upper end of the outer conduit.

6. The downhole tool of claim 1, wherein the pressure regulated valve is rotatably coupled to the upper end of the outer conduit.

7. The downhole tool of claim 1, wherein the pressure regulated valve is coupled to the upper end of the outer conduit by a spring.

8. The downhole tool of claim 1, wherein the pressure regulated valve is retractably coupled to the upper end of the outer conduit.

9. The downhole tool of claim 1, wherein the bottom end of the outer conduit is sealed to the inner conduit.

10. The downhole tool of claim 1, wherein the inner conduit is configured to receive fluid from a lower section.

11. The downhole tool of claim 1, wherein the outer conduit is configured to pass fluid to an upper section.

12. The downhole tool of claim 1, wherein the one or more angled passageways include at least two passageways of different flow area from one another.

13. The downhole tool of claim 1, wherein the at least one of the one or more angled passageways are sized to promote a sand bridging effect therein without allowing sand to travel into the inner conduit.

14. The downhole tool of claim 1, further comprising an electrical submersible pump operatively coupled to the inner conduit.

15. The downhole tool of claim 1, wherein the pressure regulated valve is rotatably coupled to the upper end of the outer conduit, wherein the pressure regulated valve is coupled to the upper end of the outer conduit by a spring, or wherein the pressure regulated valve is retractably coupled to the upper end of the outer conduit.

16. A production string for an oil and gas well, comprising:

production tubing extending along the oil and well;

a downhole tool attached to the production tubing, and one or more electrical submersible pumps attached to the downhole tool;

wherein the downhole tool is configured to prevent pump blockage in the one or more electrical submersible pumps, the downhole tool comprising:

an outer conduit defining an outer flow path therethrough in an axial direction having a lower end and an upper end;

an inner conduit located within the outer conduit defining an inner flow path therethrough in the axial direction and a space between the inner conduit and the outer conduit, wherein the inner conduit includes one or more angled passageways configured to allow one-way debris flow, wherein at least one of the angled passageways is formed having a variable slot width across its length to permit passage of varying size particles without clogging, and wherein the inner conduit includes an upper end having a first angled face and a second angled face; and a pressure regulated valve coupled to the upper end of the outer conduit configured to open to expand an adjustable width angled passageway defined by the pressure regulated valve and an upper end of the inner conduit configured to allow fluid bypass of the angled passageways of the inner conduit when the angled passageways are blocked with debris.

17. The production string of claim 16, wherein each of the angled faces include a concave opening.

18. The production string of claim 16, wherein the pressure regulated valve includes an interface contacting the upper end of the inner conduit when the angled passageways of the inner conduit are open.

19. The production string of claim 18, wherein the interface of the pressure regulated valve is V-shaped and is configured to orient with the angled faces of the inner conduit and form the adjustable width angled passageway.

20. The production string of claim 16, wherein the pressure regulated valve is rotatably coupled to the upper end of the outer conduit, wherein the pressure regulated valve is coupled to the upper end of the outer conduit by a spring, or wherein the pressure regulated valve is retractably coupled to the upper end of the outer conduit.

* * * * *